US008272183B2

(12) United States Patent
Dodge et al.

(10) Patent No.: US 8,272,183 B2
(45) Date of Patent: Sep. 25, 2012

(54) SHEATHING AND SIDING HANGERS

(75) Inventors: Monty Wayne Dodge, Graham, WA (US); Lisa Kay Dodge, Graham, WA (US)

(73) Assignee: Dodge Solutions LLC, Graham, WA (US)

( * ) Notice: Subject to any disclaimer, the term of this patent is extended or adjusted under 35 U.S.C. 154(b) by 30 days.

(21) Appl. No.: 12/924,213

(22) Filed: Sep. 23, 2010

(65) Prior Publication Data

US 2012/0073232 A1 Mar. 29, 2012

(51) Int. Cl.
*E04B 2/00* (2006.01)
*E04B 5/00* (2006.01)
*E04B 9/00* (2006.01)

(52) U.S. Cl. ..... 52/506.05; 248/300; 52/478; 52/712

(58) Field of Classification Search ..... 52/478, 52/506.05, 712, 454, 518, 545, 428, 707; 248/300, 301, 308, 215
See application file for complete search history.

(56) References Cited

U.S. PATENT DOCUMENTS 4,089,141 A * 5/1978 Heroux ..... 52/105
4,646,501 A * 3/1987 Champagne et al. ..... 52/520
4,698,942 A * 10/1987 Swartz ..... 52/99
5,564,245 A * 10/1996 Rademacher ..... 52/520
5,937,600 A * 8/1999 Larson ..... 52/302.6
7,546,719 B1 * 6/2009 Guevara ..... 52/716.2

* cited by examiner

*Primary Examiner* — Brian Glessner
*Assistant Examiner* — Paola Agudelo

(57) ABSTRACT

A corrosion-resistant, metal building construction connective hardware for installing the starter row of wall sheathing, roof sheathing/decking, or board siding to a structure comprising a flat, bendable, support tab (25) containing a nail or fastener hole (28) that extends at the bend line into a 1" wide by 1.5" to 3.5" tall, vertical, upper arm (20) that tilts forward 3° to 6° (32) to form a 1" wide by 1" tall, lower arm (22) that reclines the material being hung against the structure and holds the material in a horizontal, L-shaped resting mount (24), of sufficient depth, to fit the material being hung, whereby a narrow, holding lip (26) forms a front edge that boxes the material into the resting mount (24) and is imprinted for identification and verification purpoes. The lip is easily painted or stained to match the exterior finish. The invention is versatile and multiple pieces can be connected to the mud-sill to install the starter row of wall sheathing or siding; to the bottom edge of wall sheathing to install the starter row of siding; or to the top of each roof rafter tail-end to install the starter row of roof sheathing/decking.

23 Claims, 8 Drawing Sheets

SHEATHING AND SIDING HANGERS

CROSS-REFERENCE TO RELATED APPLICATIONS

Not Applicable.

BACKGROUND

1. Field of Invention

This invention is a building construction connective hardware designed to be connected to the mud sill to install the starter row of OSB, plywood or similar wall sheathing; to be connected to the bottom of the wall sheathing to install the starter row of siding, and wood siding products; or to be connected to the roof rafter tail-ends to install the starter row of roof sheathing on a structure.

2. Discussion of Prior Art

Currently, the installation of sheathing and siding to buildings is done without the aid of fasteners, other than nails, in a non-uniform, labor intensive process. Common practice is for each sheet of sheathing to be fitted by hand and nailed onto the structure. For example, one person holds the sheet of osb or plywood in place as another person checks to make sure it is level and plumb and nails the sheathing to the framing. A team of installers might use a nail at the joint between the mud sill and the foundation wall as a temporary holder for the sheet materials, which makes the sheathing level with the mud sill; however, to get a better weather seal the sheathing should hang below the mud sill approximately 1", which requires a person(s) to hold it in place by either eyeballing the fit or following a chalk line. As the wall is sheathed in this manner, one end of the wall may be off its mark by as little as a 1/16" or more inches, forcing the reinstallation of the sheathing. The sheathing and siding hangers will do away with this inaccuracy, by creating a solid and level resting mount, at an ideal, approximately 1" drop below the mudsill for proper weather sealing. Once set on the hanger, the sheathing can be nailed on as usual. It is envisioned that two or more hangers will be needed to hang one sheet or piece of material, depending on its size or orientation and the discretion of the installer.

Good building practice is to hang the wall sheathing at least 1" below the mud sill and off the ground by at least 6", depending on the material being installed, to help create a proper weather seal. There is no conclusive method to check for this application in the field, because once the sheathing is installed, the mud sill is covered. By introducing a piece of hardware that affixes to the foundation and mud sill in such a way that it creates an approximately 1" tall, flat resting mount for hanging the material, the installer, inspector or building owner can easily make a visual inspection of the presence of this sheathing or siding hanger and recognize it by name or model number. It may even be identified as an element on architectural or engineering plans.

The invention provides ergonomic and safety benefits to the laborers in the field, who are installing heavy OSB or plywood wall sheathing or wood siding products that come in large sheets or difficult to handle planks, to a building structure at points low to the ground or else high off the ground. In addition, use of the invention eliminates the need for an installer to be on his hands and knees marking the foundation with a measuring tape and pencil or chalk, the full length of the building, to determine the placement of the bottom edge of the sheathing or siding. In addition, the invention, once connected to the mud sill with nails or screws, will bear the weight of the material being installed and hold the material up against the building, so that the laborer is relieved from having to hold and apply pressure to the material in awkward positions, while also trying to nail the material properly on the structure.

The invention can be attached to the bottom edge of installed OSB, plywood or similar type wall sheathing to hang the starter row of wood siding products such as cedar or redwood planks.

The sheathing hangers can also be used at the edge of the roofline. The hangers would attach to the rafter tail-ends, creating a solid mount for resting the roof sheathing starter row, where it can then be nailed on and connected to the remaining roof. Current practice is to hold the sheathing in place by hand at the edge of the roof, which is awkward and labor intensive.

The installation of OSB or plywood to the roof, as currently practiced, is unstable and dangerous. The laborer has to carry the plywood or OSB up a ladder and try to set the material on the roof rafters or trusses in the proper position at the roof's edge, by hand. He is typically standing on a ladder or scaffolding, or else is trying to balance on top of the roof, working downward, to position and hold the sheathing material in place, by hand, so that the edges of the plywood or similar material are lined up evenly. By connecting the new invention to the top of each roof rafter tail-end or truss tip, a stop edge is created that will not only hold the plywood sheathing in place evenly around the perimeter of the roof, but will help keep loose material from sliding off the roof and injuring people or property below. With the plywood or OSB aligned and sitting in the resting mount of the invention, the plywood can be easily nailed in place on the roof, with highly reduced risk of material slippage and far less strain and risk to the installer.

At this time, I am not aware of any prior connective hardware on the market that is specifically designed and constructed for holding and supporting the starter row of wall sheathing and various types of siding at the mud sill and foundation, and the starter row of roof sheathing at the rafter tail-ends.

SUMMARY

This invention is a building construction connective hardware made of corrosion-resistant metal in a known stamping or molding process , which comprises a flat, 1" wide, rectangular upper straight arm, between 1.5" to 3.5" in height, with a , bendable support tab on top of the upper arm and a 3° to 6° angle forward bend at the bottom of the arm into a 1" lower arm that bends at a right angle into an L-shaped, horizontal resting mount of sufficient depth to fit the thickness of the material being hung, with a narrow, holding lip to box the material in on the resting mount that is used for identification and verification purposes when imprinted. The invention is connected to the building at the mud sill, at the bottom of the exterior wall sheathing, or on the top of the roof rafter tail-ends depending on its use. The invention fits OSB, plywood, or wood plank siding and is ideal for installing the starter row of these materials on a building structure, but may have other applications on other parts of a building.

OBJECTS AND ADVANTAGES

Several objects and advantages of my invention are:

(a) to aid in the installation of wall sheathing and most types of siding to a building structure at the mud sill or foundation level;

(b) to be a uniform, solid resting mount for hanging the starter row of wall sheathing and some types of siding to a building;

(c) to level the sheathing and some types of siding around the entire structure;

(d) to be a means for an inspecting body to verify that the sheathing is hanging at a uniform height below the mud sill;

(e) to create a uniform, solid resting mount on the roof rafter tail-ends for the starter row of the roof sheathing;

(f) to reduce the amount of manpower needed to install wall or roof sheathing and most types of siding to a structure, because the hangers help support and level the weight of the material on its edge, relieving a person(s) from having to firmly hold it up and in place as it is nailed on.

(g) to create a stop edge on the top of the roof rafter tail-ends to prevent material from falling off the roof and causing injury or damage to people or property below;

(h) to improve safety and ergonomics for the laborer by taking the weight of the material being installed off the man and connecting the material to the structure, so that the laborer's hands are free to nail the material to the building without fighting gravity and maintaining awkward and dangerous positions to do the work.

Further objects and advantages of my invention may become known from a review of the drawings and the following descriptions.

DRAWING FIGURES

In the drawings, closely related figures have the same number, but the alphabetic suffix "A" refers to an embodiment of the invention and the alphabetic suffix "B" refers to a drawing of "A" installed on a structure. "C" refers to a drawing of version of "A" modified for a corner.

REFERENCE NUMERALS IN DRAWINGS

| | |
|---|---|
| 20 | 1" w by 1.5" to 3.5" h upper straight arm |
| 21 | side arm |
| 22 | 1" w by 1" h lower arm |
| 24 | 1" w by ¼" to 1.5" d resting mount |
| 25 | 1" w bendable support tab |
| 26 | holding lip |
| 28 | nail hole |
| 30 | 90° bend |
| 32 | slight bend, 3°-6° |
| 40 | foundation wall |
| 50 | mud sill |
| 70 | osb or plywood sheathing |

DESCRIPTION FIGS. 4A, 1A, 1B, 4B, 1C

Preferred Embodiment

Figure 1B:
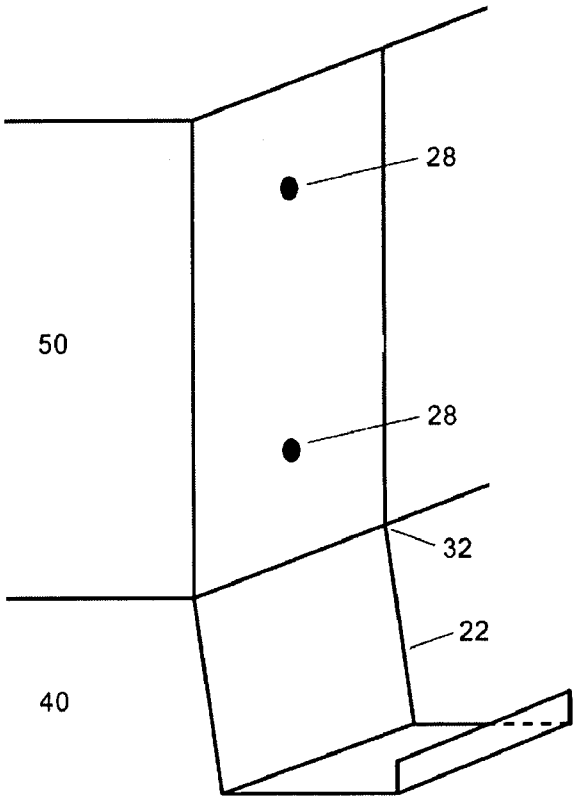
FIG. 1B shows FIG. 1A nailed to the mud sill and hanging down the foundation wall.
Figure 1A:
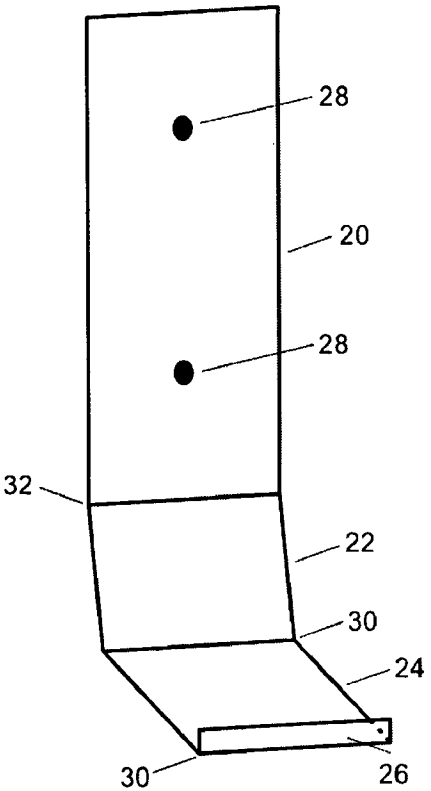
FIG. 1A shows a sheathing and siding hanger with one L-shaped resting mount.
Figure 4B:
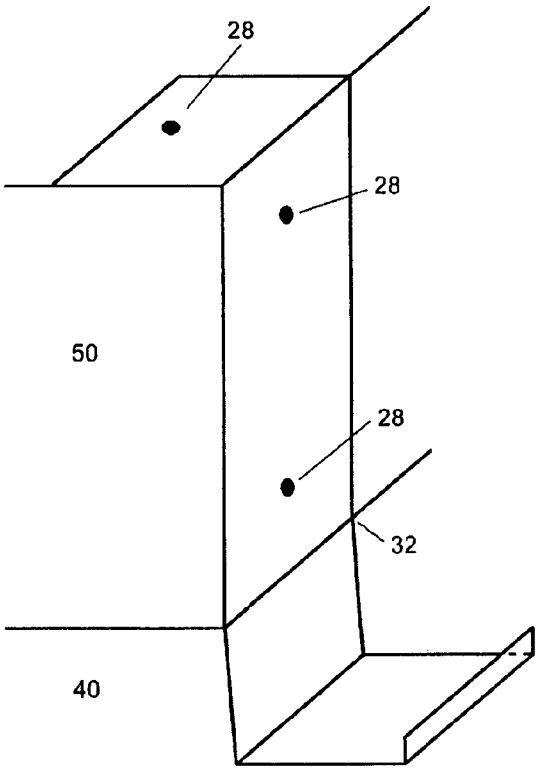
FIG. 4B shows FIG. 4A adhered to a mud sill with an upside down L-shaped, support tab nailed to the top of the mud sill and the upper arm of the hanger nailed to the side of the mud sill.
Figure 4A:
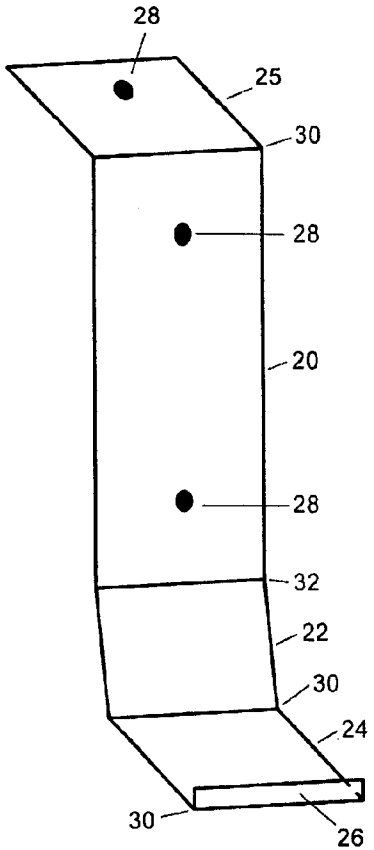
FIG. 4A shows a sheathing and siding hanger similar to FIG. 1A but with a top bendable support tab containing a nail hole, that has been bent back in a right angle to mount on a flat surface.

A preferred embodiment of the invention is shown in FIG. 4A. The hanger is to be made of a corrosion-resistant, 18-20 gauge metal such as zinc-coated, galvanized steel. The invention is relatively flat and 1" wide, The hanger is made using a known metal stamping or molding process. The invention consists of a flat, rectangular shaped vertical upper straight arm 20, which may range in height from approximately 1.5"-3.5" to fit the height of the mud sill. On top of the upper arm 20 of FIG. 4A is an approximately 1" by 1" tall, bendable portion 25, that when bent, becomes a support tab that can be placed on top of the mud sill, so that the lower arm 22 hangs below the mudsill 50 as illustrated in FIG. 4B. If the bendable portion 25 on FIG. 4A is left unbent and used in a straight position, as drawn in FIG. 1A, it can be connected to the mud sill as in FIG. 1B or connected to the top of the roof rafter tail-ends or to the bottom edge of the exterior wall sheathing. Left unbent the preferred embodiment can also act as an adjustable leveler for repairing out of level sheathing or siding. The hanger is envisioned to be fastened to the structure using nails or screws at the holes 28. The hanger has a slight 3° to 6° upward bend 32 at the bottom of the upper arm, which starts the 1" h lower arm 22. There is a right angle bend 30 at the bottom of the lower arm 22, forming an L-shaped, horizontal resting mount 24 for the sheathing or siding. The depth of the resting mount 24 is designed to fit the materials being hung. The resting mount 24 is edged in front with a narrow approximately 3/16" h, holding lip 26, which is at a right angle 30 to the resting mount 24, such that 26 boxes the material in place on the resting mount and can be used for identification and verification purposes when imprinted.

Figure 1C:
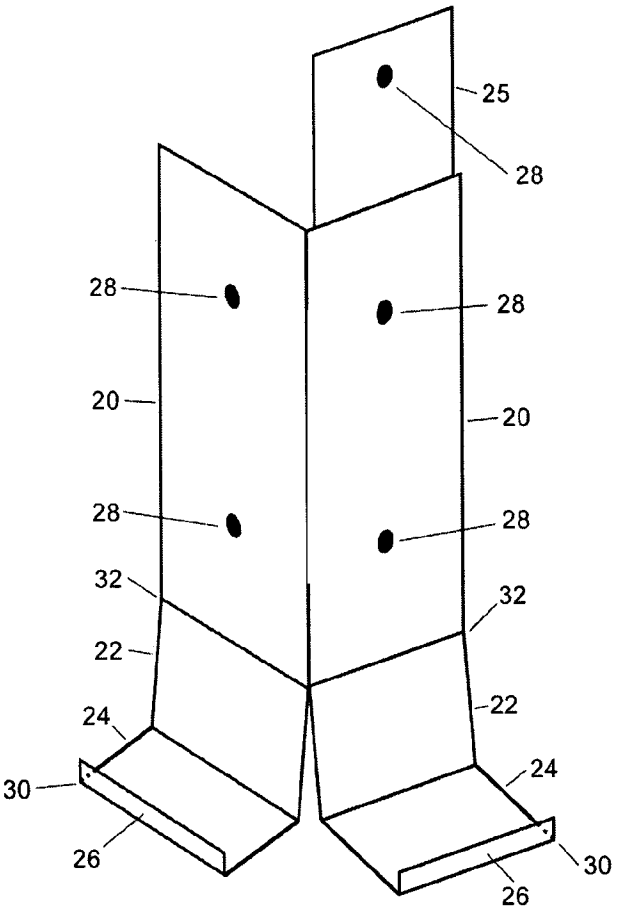
FIG. 1C shows a corner version of the sheathing and siding hanger in FIG. 4A that joins two like pieces of material at a right angle.

FIG. 1C illustrates a corner hanger of the preferred embodiment with butterfly shaped, double upper arms 20 at a right angle 30 to each other with two nail holes 28 in each arm and a fifth nail hole 28 in a top, bendable support tab 25. Two L-shaped resting mounts 24 are at the bottom of the lower arms 22 with narrow holding lips 26 on both mounts 24.

This embodiment may ideally be made of galvanized steel or zinc plated galvanized steel with nominal thickness of about 0.04" or 20 gauge. Other materials of a durable and corrosion-resistant nature could also be suited to this invention. Different thicknesses or gauges of material might be specified. In addition, the overall shape of the invention should not be limited by these drawings, such that various parts may be shorter, longer, have more curvature, greater or lesser width, or different thicknesses in order to serve this application.

In fact, additional and alternative embodiments suited to the novel idea of sheathing and siding hangers connected at the mudsill to the bottom of wall sheathing, or to the top of the roof rafter tail ends, have been illustrated in the following FIGS. 2A-3B and 5A-7B, and are described in some detail below to emphasize a range of possible shapes and support features for adapting this invention to a useful product. //// However, even the additional and alternative embodiments listed and described below do not constitute the full range of possible designs, measurements or materials which could be used to fulfill the objectives and means of this novel idea.

FIGS. 2A, 2B, 3A, 3B

Additional Embodiments

Figure 2B:
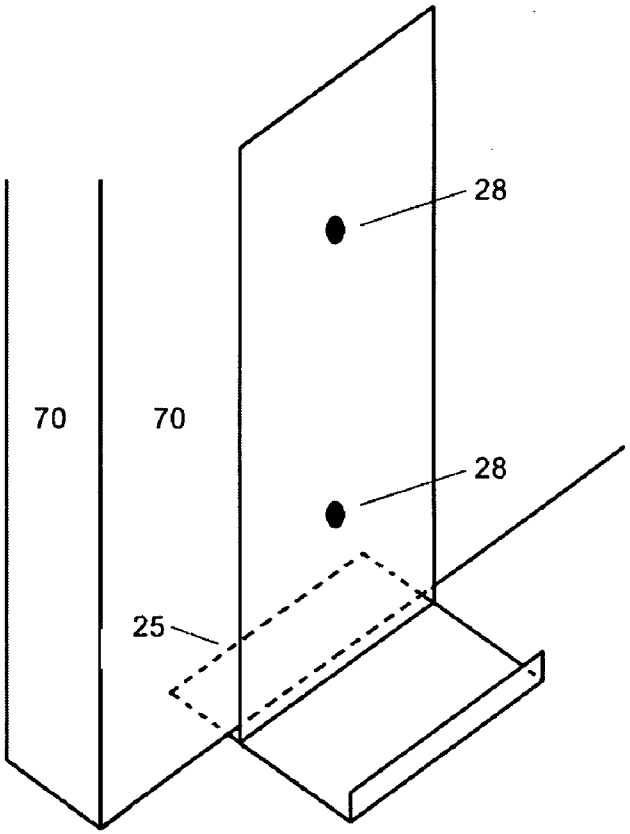
FIG. 2B shows FIG. 2A fastened to a sheet of osb or plywood sheathing with the rear support tab of the siding hanger underneath the bottom edge of the existing sheathing.
Figure 2A:
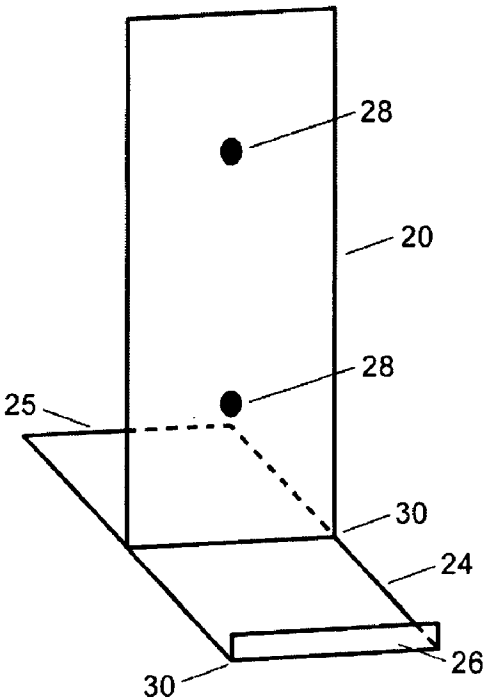
FIG. 2A shows a siding hanger with a flat T-shaped bottom comprised of a rear support tab and a single front resting mount.
Figure 3B:
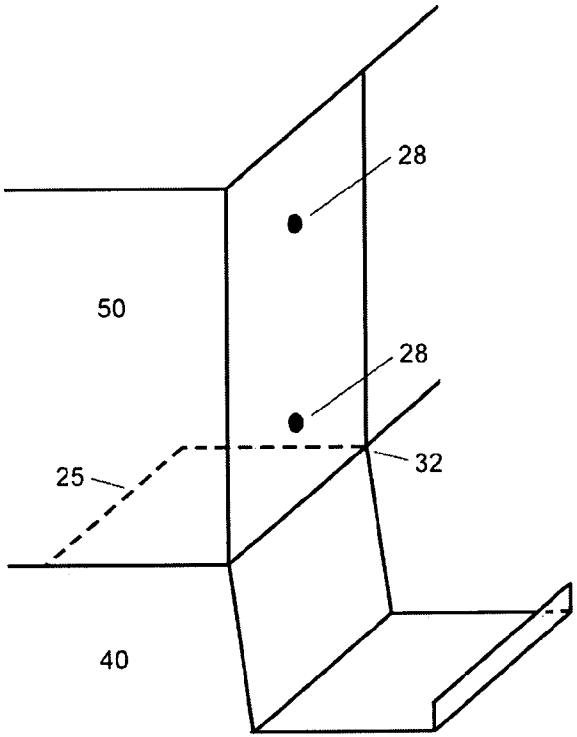
FIG. 3B shows FIG. 3A nailed to the side of the mud sill with the rear support tab inserted between the top of the foundation wall and the mud sill.
Figure 3A:
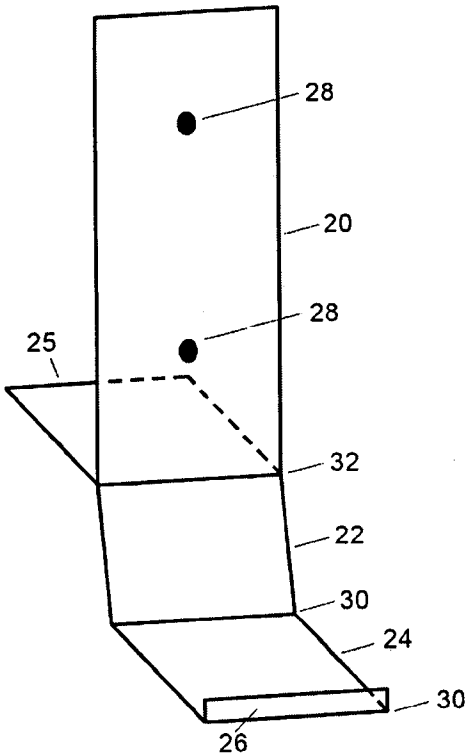
FIG. 3A shows a sheathing and siding hanger similar to FIG. 1A but with a flat, reverse L-shaped, rear tab where the lower arm bends and begins.

Additional embodiments are included in FIGS. 2A, 3A, and 4A with illustrations of how these embodiments attach to the building structure in 2B, 3B, and 4B respectively.

FIG. 2A is a metal siding hanger having a flat, rectangular shaped, vertical upper arm 20, with two nail holes 28, which rises above a bottom flat plate like an upside down T. The bottom plate is divided by the upper arm 20, such that one side forms a rear support tab 25 and the other side forms a resting mount 24 that ends in a narrow holding lip 26 for keeping the material in place. This siding hanger is designed to be nailed on to the sheathed exterior with the rear support tab 25 under the sheathing edge.

FIG. 2B shows FIG. 2A attached to a building where the osb or plywood sheathing 70 is already in place. The rear support tab 25 on this design mounts under the edge of the sheathing 70 and is adhered to the sides of it at the nail holes 28.

FIG. 3A is an additional embodiment of the invention with a rear support tab 25 perpendicular to the bottom of the upper arm 20, where the hanger bends slightly between 3°-6° upward 32 into 1" ×1" lower arm 22 that creates a recline for the material being hung. The resting mount 24 and the holding lip 26 hang from the front of the lower arm at a right angle 30.

FIG. 3B shows FIG. 3A affixed to a mud sill 50 at the fastener holes 28, with the rear tab 25 set between the top of the foundation wall 40 and below the mud sill 50. The hanger holds the sheathing material approximately 1" below the mud sill on the resting mount 24.

In FIG. 2A, the rear support tab 25 may be formed by a punch out in the bottom portion of the vertical upper arm that is bent back behind, but even with the front resting mount 24.

FIGS. 5A, 5B, 6A, 6B and 7A, 7B

Alternative Embodiments

Figure 5B:
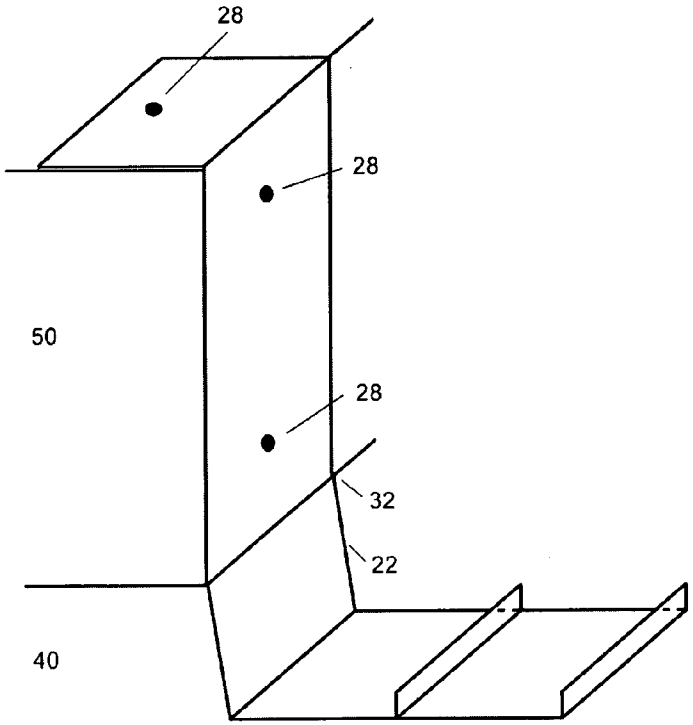
FIG. 5B shows FIG. 5A nailed to a mud sill at the top and sides, with the double resting mount perpendicular to the foundation.
Figure 5A:
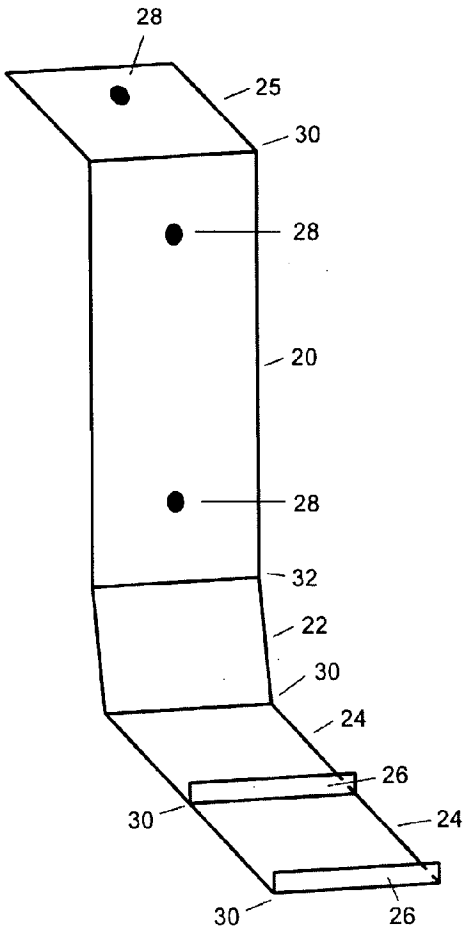
FIG. 5A shows a sheathing and siding hanger similar to FIG. 4A, but with two resting mounts, divided a barrier, for hanging two, sheets of dissimilar material, such as a sheet of plywood and a piece of siding, in a layer on the structure.

FIG. 5A is an illustration of a flat, rectangular shaped hanger similar to FIG. 4A, except that it has a longer resting mount 24 with two holding lips 26 for hanging a double layer of sheathing, or a sheathing and siding combination. The resting mount 24 is either equidistant between the two holding lips 26 or else of slightly varying width, depending on the thickness of the material being supported.

FIG. 5B shows how FIG. 5A hangs fastened to the top and sides of the mud sill 50 at the three nail holes 28. The lower arm 22 bends slightly 32 and drops approximately 1" below the mud sill 50. Two slots, created by the two resting lips 26, exist on the resting mount 24, so that a double layer of sheet materials can be held in place.

Figure 6B:
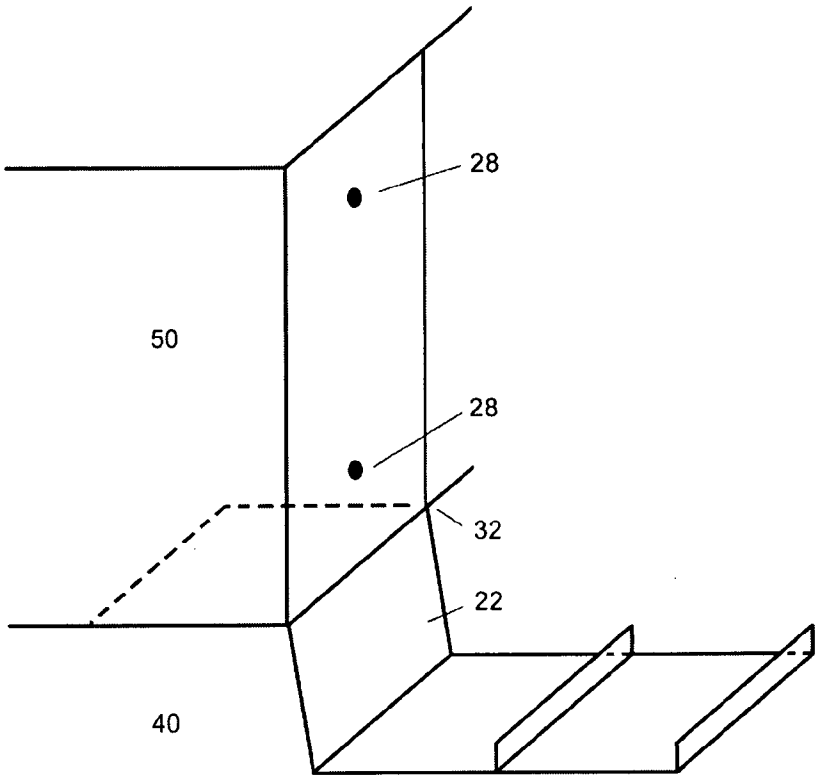
FIG. 6B shows FIG. 6A nailed to the side of a mud sill with the rear tab inserted between the top of the foundation wall and the mud sill. The double resting mounts are perpendicular to the foundation.
Figure 6A:
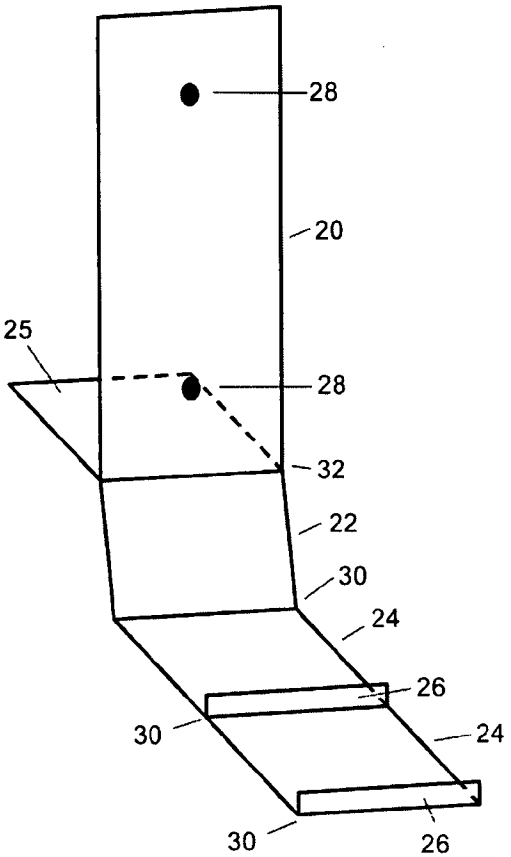
FIG. 6A shows a sheathing and siding hanger similar to FIG. 3A, but with a double resting mount for hanging two sheets of dissimilar material, such as a sheet of OSB and a 6" × 12' piece of siding, in a layer on the structure.

FIG. 6A is a hanger like the one illustrated in FIG. 3A, but with a longer resting mount 24 containing two holding lips 26, one at the middle of the resting mount 24 and one as its finished edge.

FIG. 6B shows FIG. 6A mounted between the foundation wall 40 and the mud sill 50 at the rear tab 25 and attached to the building at the nail holes 28. The resting mount 24, with the double holding lips 26, hang perpendicular to the foundation wall.

Figure 7B:
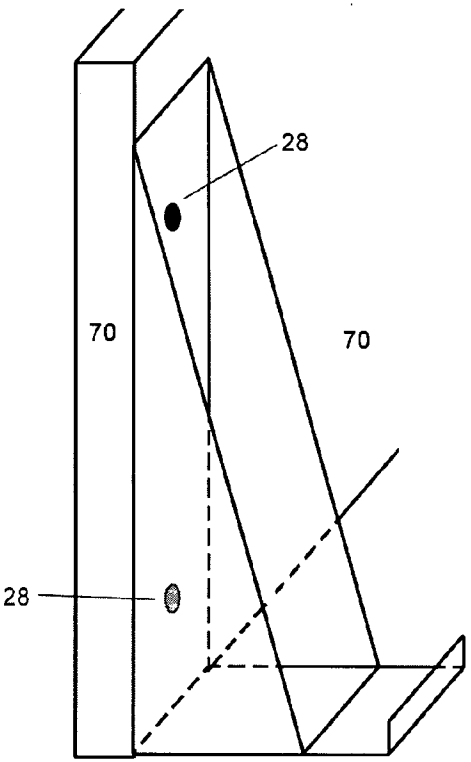
FIG. 7B shows FIG. 7A attached to a sheet of osb or plywood sheathing.
Figure 7A:
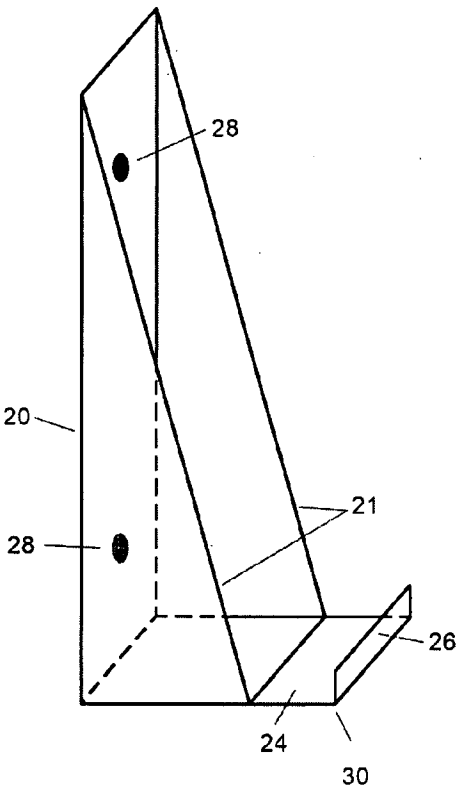
FIG. 7A shows a siding hanger shaped like an L shape, but with wedge-shaped solid side arms, a resting mount and a narrow lip for holding the siding in place at a slant against the edges of the side arms. The hanger is attached to the building structure with two nails going through the upper arm between the two side arms.

FIG. 7A demonstrates another alternative design of a siding hanger comprising a vertical, flat, rectangular arm 20 and two wedge shaped side arms 21 which serve as resting edges for the siding, so that it lays at a slant, which is necessary for some types of siding.

FIG. 7B shows how FIG. 7A is mounted to the osb or plywood sheathing 70 at the two nail holes 28. The siding leans on the edge of the side arms, sits on the resting mount 24, and is held in place by the holding lip 26.

Advantages

From the descriptions and illustrations above, a number of advantages of my sheathing and siding hangers becomes evident:

(a) The hangers provide a holding support for the starter row of wall and roof sheathing and most types of siding on a building other than nails;

(b) The hangers provide a flat surface for holding the starter row of wall and roof sheathing and most types of siding in an equal and level manner;

(c) The hangers are independent of the building and can be spaced as needed to provide an equal and level support for the sheathing and siding materials being installed;

(d) The hangers are easy to attach to an existing structure by using the built-in support tabs and nail holes;

(e) The hangers do not require specialized knowledge to use;

(f) The hangers are made of a known stamped or molded metal process with potentially some hot fusing of parts, which does not require new technology or unfamiliar manufacturing methods;

(g) The hangers are to be made of materials commonly used in the building industry, which are appropriate for this application;

(h) The hangers are to be made to specifications that fall within the recommendations of the International Building Code;

(i) The hangers make it possible for an installer or inspector to verify the height below the mud sill that the wall sheathing hangs, because the holding lip can be visually seen at the bottom of the sheathing;

(j) The hangers by design can both hold and level the sheathing and siding at their starter rows, while the materials are being nailed on to the structure, such that it relieves a person(s) from having to do these tasks and could save labor costs as a result.

(k) The hangers hold OSB and plywood, which are commonly used exterior sheathing materials.

(l) The hangers hold commonly used siding materials.

(m) The hangers create a safer and more ergonomic method of installing the starter row of wall or roof sheathing and some types of siding to a structure, by taking the weight of the material off the worker, who would otherwise have to maintain awkward and often dangerous positions while holding the material in place, especially on the roof edge.

(n) The hangers improve safety on the job by creating a stop edge on the roof line, thus reducing the risk of slippage of material off the roof.

Operation—FIGS. 1A, 1C, 2A, 3A, 4A, 5A, 6A and 7A The sheathing and siding hangers as described in the above illustrations and descriptions of the preferred, additional and alternative embodiments are easy to install on the building structure by using nails or other fasteners in the built-in nail holes 28.

The hangers can also be secured on to the structure at the mudsill, at the bottom of plywood sheathing or at the top of the roof rafter tail-ends by inserting or nailing on the support tabs 25 as designed into FIGS. 2A, 3A, 4A, 5A, and 6A.

FIGS. 1A, 2A, 3A, 4A and 7A are designed to hold one sheet or piece of material at a time. FIGS. 5A and 6A are capable of holding two layers of dissimilar types of sheet materials, thereby aiding the installation of two separate phases of construction, such that a piece of 4' ×10' plywood sheathing could sit on the inner resting mount and a piece of 4' ×10' T1-11 siding could sit on the outer resting mount, for example. FIG. 1C is a corner hanger that fits two sheets of the same material at right angles to each other.

The hangers are to be made of materials commonly used for connective hardware in the building industry.

The hangers are independently installed around the structure. Properly spaced to provide maximum support, there may be two or more hangers per sheet or piece of material, depending on its size or orientation and the discretion of the installer. The sheathing or siding is set on the hanger's resting mount 24, and supported on its edge against the building. Once set on the hangers, the sheathing or siding can be nailed onto the structure in the usual practice. The hangers remain in place as part of the finished product, providing added support to the walls of the building. The hangers are designed to aid the installer in achieving the required height of the sheathing below the mud sill and to ensure a level installation of the sheathing or siding around the entire structure. The slight holding lip 26 of the hangers can be visually inspected on the very bottom of the sheet materials, which will aid an inspecting body in determining the actual height of the material relative to the mud sill, if necessary. The holding lip 26 can be painted to match the exterior of the building if desired, such that the finished look of the product is not compromised by the presence of the hanger.

The sheathing hangers can be used to help install the starter row of the roof sheathing at the rafter tail-ends. The hangers help hold the sheathing in place at the edge of the roof, providing added support and helping create a more even roof edge.

However, the sheathing and siding hangers should not be limited by these uses. The hangers may be useful for other applications, such as hanging fence planks or lattice, or supporting wall hangings such as flower boxes, bulletin boards, or shelving.

Conclusion, Ramification and Scope

The reader can determine from the written descriptions and illustrations of the various embodiments that the invention is a construction hardware that connects to the mudsill, to the bottom of plywood sheathing, or to the end of the roof rafter or truss to install exterior wall and roof sheathing/decking as well as common siding products. When multiple pieces of the invention are installed around the structure, such that each piece of material hung requires two or three hangers, depending on the width of the material, or a hanger is connected to each roof rafter tail end, a system for installing the starter row of wall sheathing, roof sheathing/decking or siding is achieved.

Sheathing and siding is normally installed using only nails. This new application adds the hangers to the equation, such that the sheathing; siding or sheet materials are held on to the building by the hangers as well as by the nails. In addition, the hangers provide a solid mount for the material being installed that otherwise did not exist, such that the finished product is more securely fastened and thus the building could possibly enjoy a longer life with the presence of the hangers.

The hangers are to be made using a known metal stamping or molding process with, potentially, some hot fusing of components. The hangers are envisioned to be made of galvanized steel, which is a commonly used material and, therefore, should be a cost effective additive for the builder, at the same time that it is a labor saving mechanism.

The hangers are easy to install on the existing structure. The ease of installation, the level resting mount, and the holding capacity of the hangers will aid the builder in sheathing or siding the structure, and therefore should save labor costs on the project. The hangers will also allow one man rather than two or three men, as is currently required, to properly install a single piece of plywood, OSB, T1-11, fiber board, cement board, or wood siding to a structure. In addition, the safety and ergonomic benefits of the invention, when used to complete the sheathing and siding phases of construction, have important short and long-term benefits to property owners, contractors, laborers, insurance companies, and state regulated workman's compensation agencies.

The above descriptions describe many possible embodiments and a solid range of advantages and objects of this hanger, but these alone should not limit the scope of this invention. The hanger could have other shapes, additional nail holes, multiple tabs, various measurements, or be made of alternative materials such as plastic or other metals beyond what has been described or recommended. Even the uses as detailed above should not limit this invention, such that these sheathing and siding hangers may be capable of other means and functions. Thus, the scope of the invention should not be limited by the particular forms and uses as herein described for the sheathing and siding hangers, but should be determined by the claims listed and their legal values.

We claim:

1. A building construction connective hardware comprising:

a flat, bendable, support tab containing a nail hole comprising a first end and a second end;

a 1.5" to 3.5" tall, substantially vertical, upper arm comprising a first end and a second end;

wherein the second end of the support tab is connected to the first end of the upper arm via a bend line;

a 1" tall, lower arm that tilts forward at a 3° to 6° angle and is connected to the second end of the upper arm and is capable of abutting against a material being hung so that the material being hung reclines against a structure;

a resting mount that is substantially parallel to the support tab and in communication with the lower arm, having a width that is greater or equal to a thickness of a material being hung;

wherein the width of the resting mount is measured in a direction perpendicular to the upper arm;

and wherein the lower arm and the resting mount form an L-shaped support further comprising a holding lip that forms a front edge for boxing the material into the resting mount such that the holding lip is imprinted and used for identification or verification purposes.

2. The building construction connective hardware of claim 1 further comprising:

a second upper arm side by side the substantially vertical upper arm;

a second lower arm side by side and forming a right angle with the 1" tall lower arm; and a second resting mount side by side and forming a right angle with the resting mount;

wherein the connective hardware is capable of hanging two pieces of like material at a comer.

3. The building construction connective hardware of claim 1 further comprising:

an extended resting mount comprising a second holding lip;

wherein the extended resting mount extends from the front edge formed by the holding lip so that a width of the extended resting mount measured in a direction perpendicular to the upper arm is at least equal to the width of the resting mount; and wherein the connective hardware is capable of holding two layers of dissimilar material, one on the resting mount and another one on the extended resting mount.

4. The building construction connective hardware of claim 1, wherein the connective hardware is made of metal.

5. The building construction connective hardware of claim 4, wherein the metal is corrosion resistant.

6. The building construction connective hardware of claim 1, wherein the connective hardware is made of plastic.

7. The building construction connective hardware of claim 1, wherein the connective hardware hangs wood, plywood or Oriented Standard Board.

8. A system for installing sheathing or siding on a foundation mud sill comprising:

a foundation structure having a mud sill;

at least one connective hardware device attached to the mud sill with nails or fasteners;

the at least one connective hardware device comprising:

a flat, bendable, support tab containing a nail hole comprising a first end and a second end;

a 1.5" to 3.5" tall, substantially vertical, upper arm comprising a first end and a second end;

wherein the second end of the support tab is connected to the first end of the upper arm via a bend line;

a 1" tall, lower arm that tilts forward at a 3° to 6° angle and is connected to the second end of the upper arm so that the lower arm abuts against the sheathing or siding being hung so that the sheathing or siding reclines against a structure;

a resting mount that is substantially parallel to the support tab and in communication with the lower arm, having a width that is greater or equal to a thickness of the sheathing or siding;

wherein the width of the resting mount is measured in a direction perpendicular to the upper arm;

and wherein the lower arm and the resting mount form an L-shaped support further comprising a holding lip that forms a front edge for boxing the sheathing or siding into the resting mount such that the holding lip is imprinted and used for identification or verification purposes.

9. The system for installing sheathing or siding of claim 8, wherein the at least one connective hardware device hangs a starter row of wall sheathing or siding.

10. The system for installing sheathing or siding of claim 8, wherein the at least one connective hardware device further comprises a plurality of connective hardware devices installed around an entire perimeter of the foundation so that two or more connective hardware devices hang a sheet of sheathing or siding.

11. The system for installing sheathing or siding of claim 8, wherein the sheathing or siding is installed 1" below the mud sill.

12. The system for installing sheathing or siding of claim 8, wherein the at least one connective hardware device further comprises:

a second upper arm side by side the substantially vertical upper arm;

a second lower arm side by side and forming a right angle with the 1" tall lower arm; and a second resting mount side by side and forming a right angle with the resting mount;

wherein the connective hardware is capable of hanging two pieces of sheathing or siding at a corner.

13. The system for installing sheathing or siding of claim 8, wherein the connective hardware device further comprises:

an extended resting mount comprising a second holding lip;

wherein the extended resting mount extends from the front edge formed by the holding lip so that a width of the extended resting mount measured in a direction perpendicular to the upper arm is at least equal to the width of the resting mount; and wherein the connective hardware is capable of holding two layers of dissimilar material, one on the resting mount and another one on the extended resting mount.

14. The system for installing sheathing or siding of claim 8, wherein the sheathing or siding is made of wood or Oriented Standard Board.

15. A system for installing siding on a sheathed exterior of a building, comprising:

a building structure having a sheathed exterior comprising a sheet of Oriented Standard Board or plywood sheathing;

at least one connective hardware device attached to the sheet of sheathing with nails or fasteners;

the at least one connective hardware device comprising:

a flat, bendable, support tab containing a nail hole comprising a first end and a second end;

a 1.5" to 3.5" tall, substantially vertical, upper arm comprising a first end and a second end;

wherein the second end of the support tab is connected to the first end of the upper arm via a bend line;

a 1" tall, lower arm that tilts forward at a 3° to 6° angle and is connected to the second end of the upper arm so that the lower arm abuts against the siding being hung so that the siding reclines against the building;

a resting mount that is substantially parallel to the support tab and in communication with the lower arm, having a width that is greater or equal to a thickness of the siding;

wherein the width of the resting mount is measured in a direction perpendicular to the upper arm;

and wherein the lower arm and the resting mount form an L-shaped support further comprising a holding lip that forms a front edge for boxing the siding into the resting mount such that the holding lip is imprinted and used for identification or verification purposes.

16. The system for installing siding of claim 15, wherein the at least one connective hardware device hangs a starter row of siding.

17. The system for installing siding of claim 16, wherein the at least one connective hardware device further comprises a plurality of connective hardware devices installed at a bottom edge of the sheathed exterior and around the perimeter of the building structure.

18. The system for installing siding of claim 15, wherein the at least one connective hardware device further comprises:

a second upper arm side by side the substantially vertical upper arm;

a second lower arm side by side and forming a right angle with the 1" tall lower arm; and a second resting mount side by side and forming a right angle with the resting mount;

wherein the connective hardware is capable of hanging two pieces of siding at a corner.

19. The system for installing siding of claim 15, wherein the siding is made of wood.

20. A system for installing sheathing or decking on a roof, the system comprising:

A plurality of roof rafters, each having a tail end;

at least one connective hardware device attached to the roof rafter tail end with nails or fasteners;

the at least one connective hardware device comprising:

a flat, bendable, support tab containing a nail hole comprising a first end and a second end;

a 1.5" to 3.5" tall, substantially vertical, upper arm comprising a first end and a second end;

wherein the second end of the support tab is connected to the first end of the upper arm via a bend line;

a 1" tall, lower arm that tilts forward at a 3° to 6° angle and is connected to the second end of the upper arm so that the lower arm abuts against the sheathing or decking being hung so that the sheathing or decking reclines against the roof rafter;

a resting mount that is substantially parallel to the support tab and in communication with the lower arm, having a width that is greater or equal to a thickness of the sheathing or decking;

wherein the width of the resting mount is measured in a direction perpendicular to the upper arm;

and wherein the lower arm and the resting mount form an L-shaped support further comprising a holding lip that forms a front edge for boxing the sheathing or decking into the resting mount such that the holding lip is imprinted and used for identification or verification purposes.

21. The system for installing sheathing or decking of claim 20, wherein the at least one connective hardware device hangs a starter row of roof sheathing or decking.

22. The system for installing sheathing or decking of claim 20, wherein the sheathing or decking is made of a material selected from the group consisting of wood, plywood and Oriented Standard Board.

23. The system for installing sheathing or decking of claim 20, wherein each of the at least one connective hardware devices is attached to each roof end tail.

* * * * *